US006643866B1

(12) United States Patent
Stewart

(10) Patent No.: US 6,643,866 B1
(45) Date of Patent: Nov. 11, 2003

(54) TOILET-SEAT POSITIONER

(76) Inventor: Robert L. Stewart, 9305 Knight Rd., Bonita Springs, FL (US) 34135

( * ) Notice: Subject to any disclaimer, the term of this patent is extended or adjusted under 35 U.S.C. 154(b) by 0 days.

(21) Appl. No.: 10/263,545

(22) Filed: Oct. 2, 2002

(51) Int. Cl.[7] ..... A47K 13/10
(52) U.S. Cl. ..... 4/667
(58) Field of Search ..... 4/254, 480, 667

(56) References Cited

U.S. PATENT DOCUMENTS

| | | | | | |
|---|---|---|---|---|---|
| 3,473,174 | A | | 10/1969 | Cool | |
| 4,168,552 | A | | 9/1979 | Austin | |
| 4,587,678 | A | * | 5/1986 | Love et al. | 4/667 |
| 4,884,841 | A | | 12/1989 | Holley | |
| 4,888,833 | A | | 12/1989 | Garcia et al. | |
| 5,381,565 | A | | 1/1995 | Schmidt | |
| 5,588,162 | A | | 12/1996 | Robinson | |
| 5,592,703 | A | | 1/1997 | Jones et al. | |
| 5,737,780 | A | | 4/1998 | Okita et al. | |
| 6,035,462 | A | * | 3/2000 | Bennett et al. | 4/667 |
| 6,553,585 | B1 | * | 4/2003 | Lundstrom | 4/667 |

* cited by examiner

*Primary Examiner*—Robert M. Fetsuga
(74) *Attorney, Agent, or Firm*—Edward M. Livingston

(57) ABSTRACT

A toilet-seat positioner has a base frame (1) with a first-side rod (2), a second-side rod (3) and a frame-front rod (4). The first-side rod is made to be placed beside a first side of a toilet bowl (5). The second-side rod is made to be placed beside a second side of the toilet bowl. The first-side rod and the second-side rod are attached to the frame-front rod for bracketing the toilet bowl. In the absence of a toilet bowl between the first-side rod and the second-side rod, the base frame can be positioned over a portable defecation container (22) which can include a bed pan, a pot or a portable toilet. A first pneumatic cylinder (10) has a bottom end attached pivotally to an aft end of the first-side rod. A second pneumatic cylinder (11) has a bottom end attached pivotally to an aft end of the second-side rod. A pneumatic pressurizer (15) is positioned on the base frame for supplying pneumatic pressure to the first pneumatic cylinder and to the second pneumatic cylinder through pneumatic conveyances (18) in response to operation of a tank-outlet valve (24). A top end of the first pneumatic cylinder and a top end of the second pneumatic cylinder are attachable pivotally to an aft portion of a front-hinged toilet seat (19) that is front-hinged to a toilet or that is front-hinged to a toilet-seat frame.

12 Claims, 3 Drawing Sheets

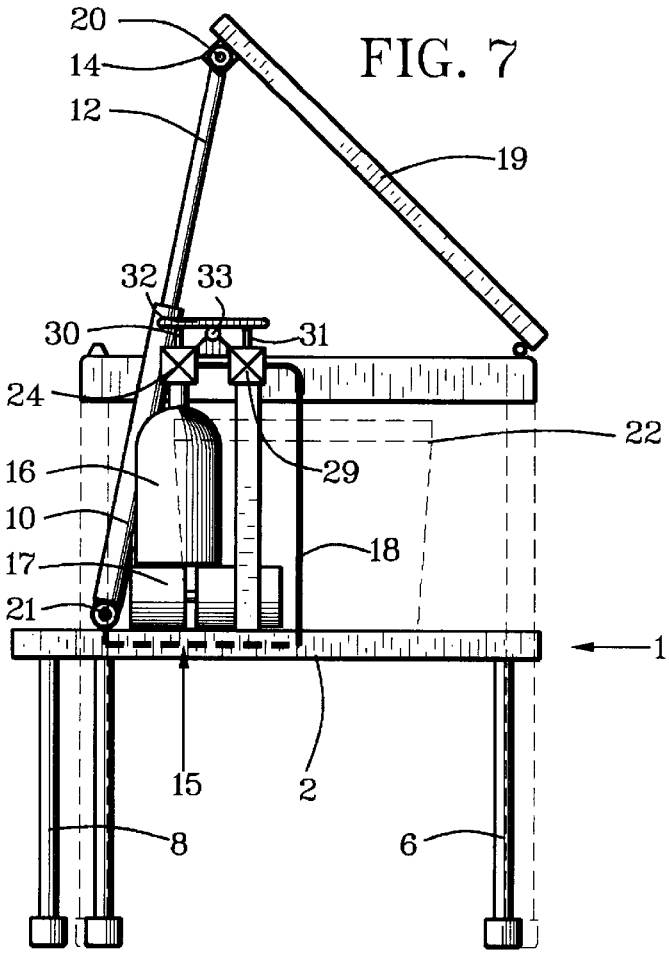
FIG. 7
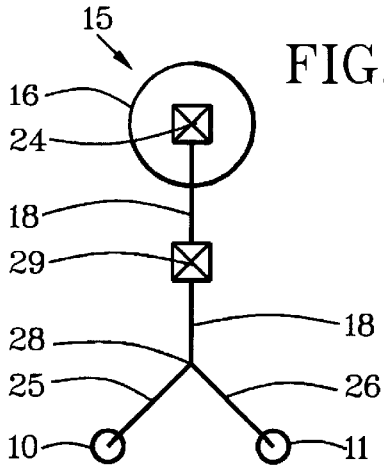
FIG. 8
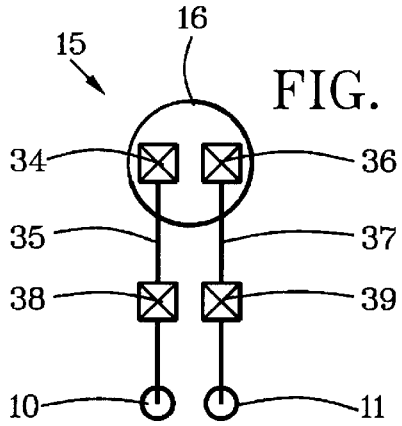
FIG. 9
FIG. 10
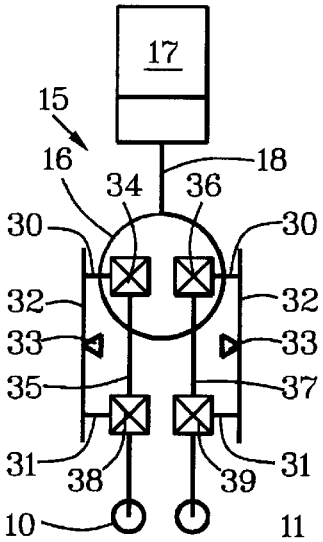
FIG. 11
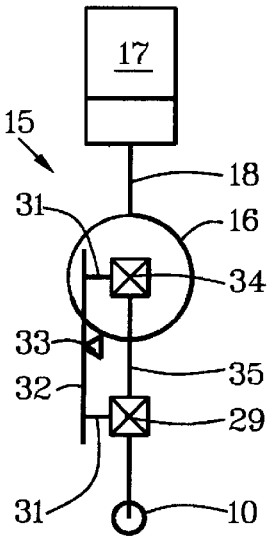

TOILET-SEAT POSITIONER

BACKGROUND OF THE INVENTION

This invention relates to positioning toilet seats for being accessed and for being departed from by disabled people.

There are known devices for positioning toilet seats for disabled and aged people to help them get on and off of toilets, but none with the convenience of use and adaptability to different types of toilet seats and to use of bedside commodes also in a manner taught by this invention.

Examples of most-closely related known but different devices are described in the following patent documents:

| U.S. Pat. No. | Inventor | Issue Date |
|---|---|---|
| 4,884,841 | Holley | Dec. 05, 1989 |
| 5,592,703 | Jones, et al. | Jan. 14, 1997 |
| 5,588,162 | Robinson | Dec. 31, 1996 |
| 4,888,833 | Garcia, et al. | Dec. 26, 1989 |
| 5,737,780 | Okita, et al. | Apr. 14, 1998 |
| 3,473,174 | Cool | Oct. 21, 1969 |
| 4,168,552 | Austin | Sep. 25, 1979 |
| 5,381,565 | Schmidt | Jan. 17, 1995 |

SUMMARY OF THE INVENTION

Objects of patentable novelty and utility taught by this invention are to provide a toilet-seat positioner which:

can be used to raise and lower a rear of a front-hinged toilet seat controllably with a person on the toilet seat either above a toilet or above a bedside commode contained on the toilet-seat positioner;

can be made to operate with stored air pressure; and can include hand rails and other hand-assist items.

This invention accomplishes these and other objectives with a toilet-seat positioner having a base frame with a first-side rod, a second-side rod and a frame-front rod. The first-side rod is made to be placed beside a first side of a toilet bowl. The second-side rod is made to be placed beside a second side of the toilet bowl. The first-side rod and the second-side rod are attached to the frame-front rod for bracketing the toilet bowl. In the absence of a toilet bowl between the first-side rod and the second-side rod, the base frame can support a portable defecation container which can include a bedside commode. A first pneumatic cylinder has a bottom end attached pivotally to an aft end of the first-side rod. A second pneumatic cylinder has a bottom end attached pivotally to an aft end of the second-side rod. A pneumatic pressurizer is positioned on the base frame for supplying pneumatic pressure to the first pneumatic cylinder and to the second pneumatic cylinder through pneumatic conveyances in response to a tank-outlet valve. A top end of the first pneumatic cylinder and a top end of the second pneumatic cylinder are attachable pivotally to an aft portion of a toilet seat that is front-hinged to a toilet or that is front-hinged to a toilet-seat frame.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 7 is a side view of the toilet-seat positioner having a lever pivotal on a fulcrum for operating a tank-valve rod and a conveyer-valve rod;

FIG. 8 is a schematic representation of a hand-operable tank valve and a hand-operable conveyor valve in communication of pneumatic pressure to two pneumatic cylinders through a two-branch tube;

FIG. 9 is a schematic representation of a first hand-operable tank valve and a first hand-operable conveyor valve in communication of pneumatic pressure to a first pneumatic cylinder in combination with a second hand-operable tank valve and a second hand-operable conveyor valve in communication of pneumatic pressure to a second pneumatic cylinder;

FIG. 10 is a schematic representation of a first lever-operable tank valve and a first lever-operable conveyor valve in communication of pneumatic pressure to a first pneumatic cylinder in combination with a second lever-operable tank valve and a second lever-operable conveyor valve in communication of pneumatic pressure to a second pneumatic cylinder; and FIG. 11 is a schematic representation of a single lever-operable tank valve and a single lever-operable conveyor valve in communication of pneumatic pressure to a single pneumatic cylinder.

DESCRIPTION OF PREFERRED EMBODIMENT

Figure 1:
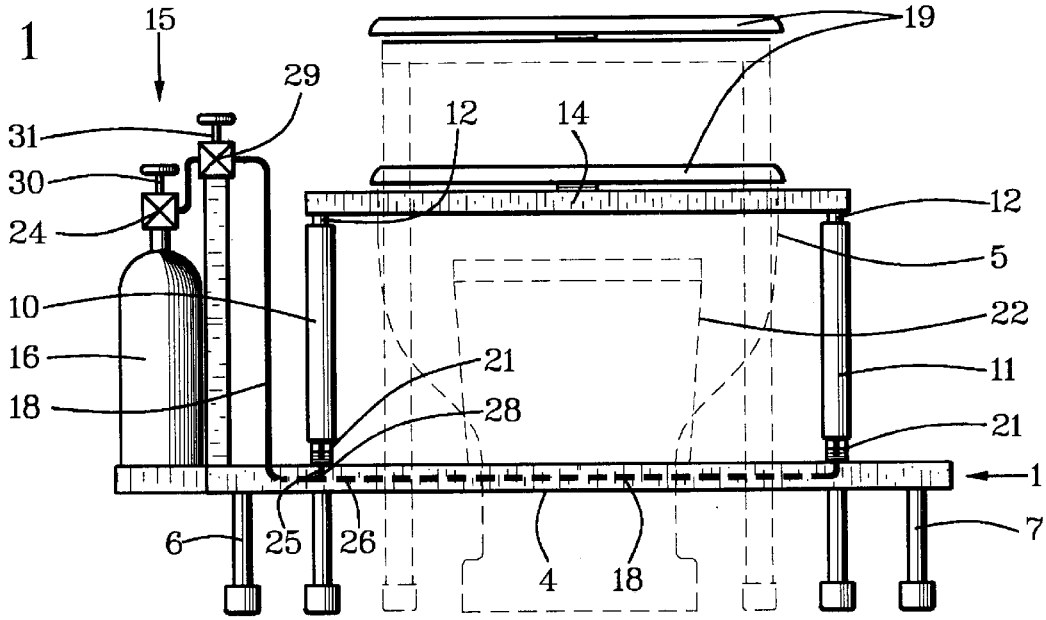
FIG. 1 is a front view of the toilet-seat positioner with partially dashed-line representations of positional relationships to a toilet, a toilet stand and a defecation container.

Listed numerically below with reference to the drawings are terms used to describe features of this invention. These terms and numbers assigned to them designate the same features throughout this description.

1. Base frame
2. First-side rod
3. Second-side rod
4. Frame-front rod
5. Toilet bowl
6. First frame leg
7. Second frame leg
8. Third frame leg
9. Fourth frame leg
10. First pneumatic cylinder
11. Second pneumatic cylinder
12. Cylinder rod
13. Pneumatic piston
14. Seat-lift member
15. Pneumatic pressurizer
16. Container
17. $CO_2$ tank or motorized compressor
18. Pneumatic conveyance
19. Front-hinged toilet seat

Figure 2:
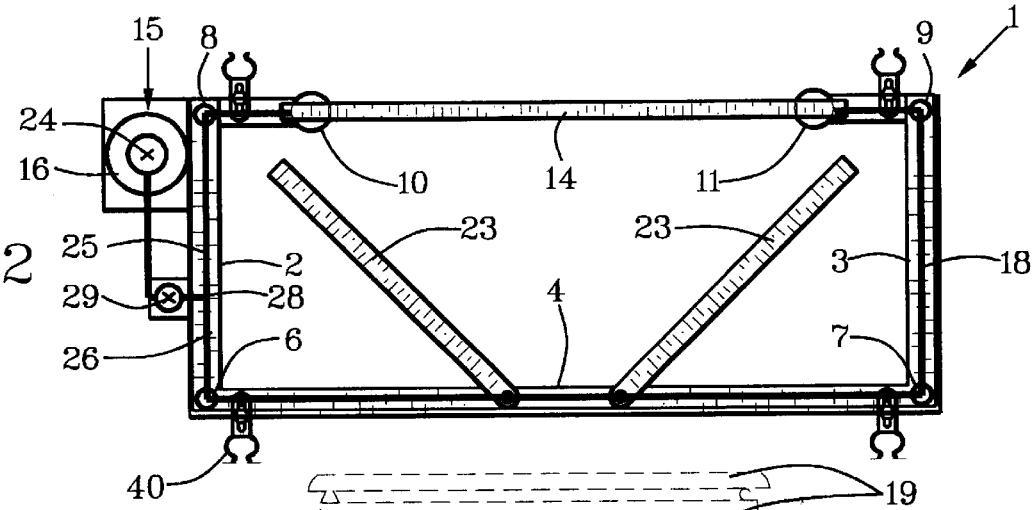
FIG. 2 is a top view of the toilet-seat positioner.
Figure 3:
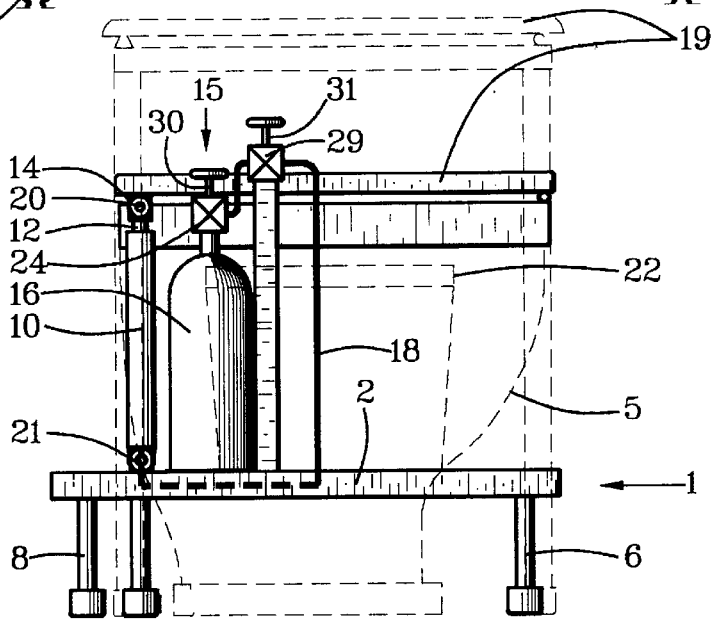
FIG. 3 is a side view of the FIG. 1 illustration.
Figure 4:
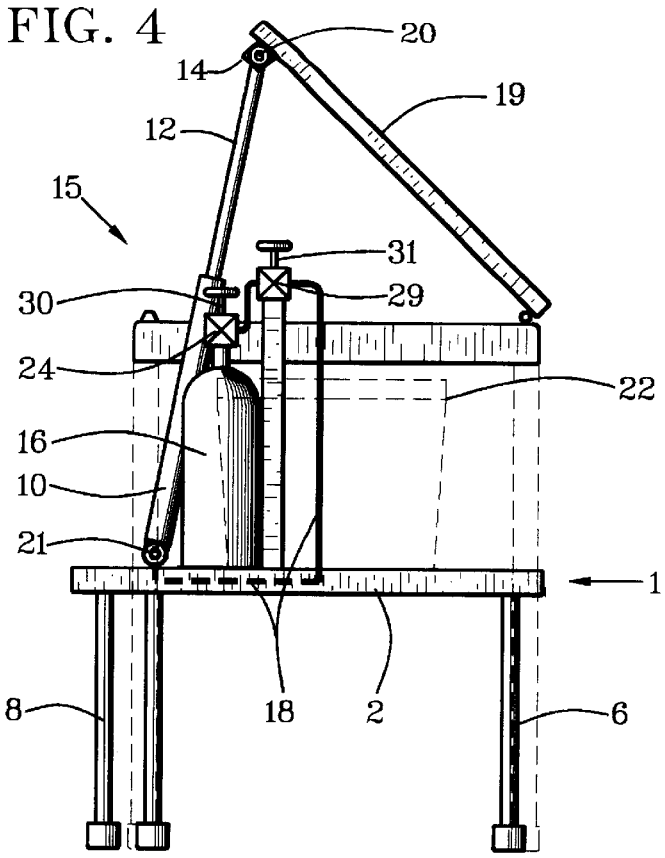
FIG. 4 is a side view of the toilet-seat positioner positioning an aft end of a front-hinged toilet seat upwardly from a seat base of a raised toilet frame that is shown partially with dashed lines.
Figure 5:
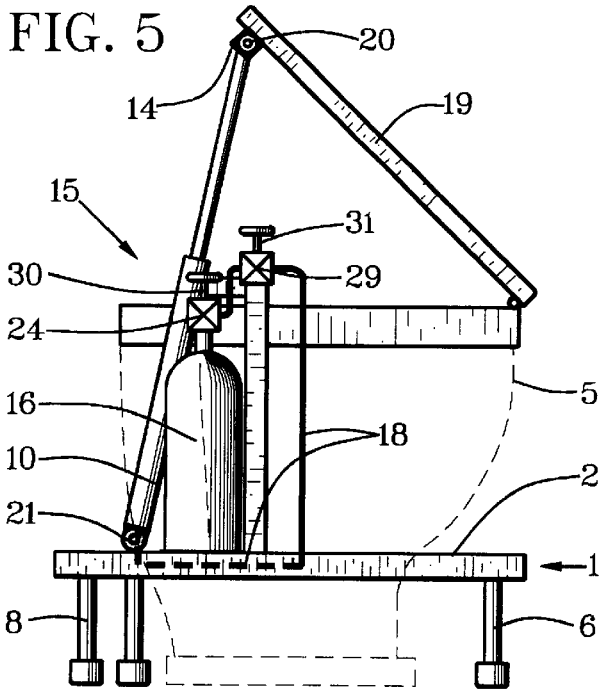
FIG. 5 is a side view of the toilet-seat positioner positioning an aft end of a front-hinged toilet seat upwardly from a seat base of a toilet that is shown partially with dashed lines.
Figure 6:
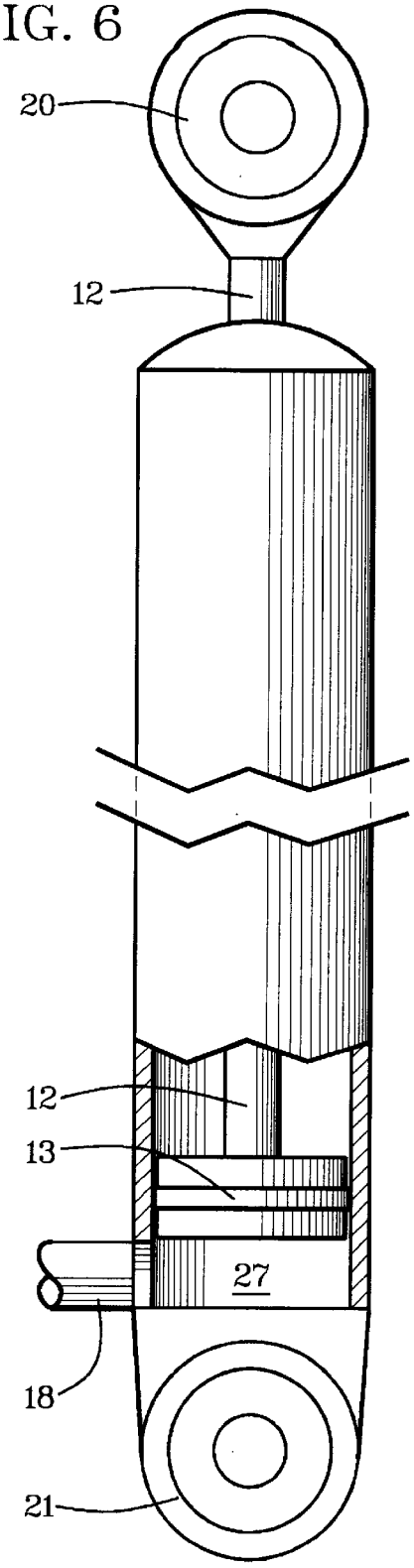
FIG. 6 is a partially cutaway side view of a pneumatic cylinder having pivotal attachment ends.

20. Rod pivot member
21. Cylinder pivot member
22. Portable defecation container
23. Pivotal frame rods
24. Tank-outlet valve
25. First conveyor tube
26. Second conveyor tube
27. Cylinder-head portion
28. Two-branch connector
29. Pressure-relief valve
30. Tank-valve rod
31. Conveyor-valve rod
32. Valve lever
33. Valve fulcrum
34. Dual first tank-outlet valve
35. Dual first conveyor tube
36. Dual second tank-outlet valve
37. Duel second conveyor tube
38. Dual first pressure-relief valve
39. Dual second pressure-relief valve
40. Leg clamp Referring to FIGS. 1–7, the toilet-seat positioner has a base frame 1 with a first-side rod 2, a second-side rod 3 and a frame-front rod 4. The first-side rod 2 is extended rearwardly from a first end of the frame-front rod 4 at a first frame corner. The second-side rod 3 is extended rearwardly from a second end of the frame-front rod 4 at a second frame corner.

The first-side rod 2 is positioned a distance from the second-side rod 3 for receiving a toilet bowl 5 predeterminedly intermediate the first-side rod 2 and the second-side rod 3, the first-side rod 2 having a length and the second-side rod 3 having a length for receiving the toilet bowl 5 predeterminedly intermediate the frame-front rod 4 and within the length of the first-side rod 2 and within the length of the second-side rod 3.

The base frame 1 includes a first frame leg 6 on which the first frame comer is positioned, a second frame leg 7 on which the second frame comer is positioned, a third frame leg 8 on which an aft end of the first-side rod 2 is positioned, and a fourth frame leg 9 on which an aft end of the second-side rod 3 is positioned.

A first pneumatic cylinder 10 has a bottom end attached predeterminedly to the base frame 1 proximate the aft end of the first-side rod 2. A second pneumatic cylinder 11 has a bottom end attached predeterminedly to the base frame 1 proximate the aft end of the second-side rod 3. The first pneumatic cylinder 10 has a cylinder rod 12 attached to a pneumatic piston 13 and extended upwardly from a top end of the first pneumatic cylinder 10. The second pneumatic cylinder 11 has a cylinder rod attached to a pneumatic piston 13 and extended upwardly from a top end of the second pneumatic cylinder 11.

A seat-lift member 14 is attached predeterminedly to the cylinder rod 12 of the first pneumatic cylinder 10 and to the cylinder rod 12 of the second pneumatic cylinder 11.

A pneumatic pressurizer 15 is positioned on the base frame 1. The pneumatic pressurizer 15 can include a container 16 that is filled from-time-to-time from a remote source of compressed air, such as $CO_2$ or, optionally filled by a motorized compressor 17, depicted in FIG. 7, on the base frame 1.

A pneumatic conveyance 18 is in fluid communication from the pneumatic pressurizer 15 to a bottom inside periphery of a cylinder-head portion of the first pneumatic cylinder 10 and to a bottom inside periphery of a cylinder-head portion of the second pneumatic cylinder 11 for cylinder pressurization. For cylinder depressurization, the pneumatic conveyance 18 also includes fluid communication from the bottom inside periphery of the cylinder-head portion of the first pneumatic cylinder 10 and from the bottom inside periphery of a cylinder-head portion of the second pneumatic cylinder 11 selectively.

The seat-lift member 14 is attachable predeterminedly to an aft portion of a front-hinged toilet seat 19.

The cylinder rod 12 of the first pneumatic cylinder 10 and the cylinder rod 12 of the second pneumatic cylinder 11 are attached pivotally to the seat-lift member 14 with a rod pivot member 20. The first pneumatic cylinder 10 and the second pneumatic cylinder 11 are attached pivotally to the base frame with a cylinder pivot member 21.

The base frame 1 is adapted to receive a portable defecation container 22 predeterminedly. Pivotal frame rods 23 can be attached pivotally to the frame front rod 4 for supporting the portable defecation container 22 when pivoted rearwardly. They can be pivoted outwardly to allow entry of the toilet bowl 5 when not in use for supporting the defecation container 22.

Referring to FIGS. 1–5, 7 and 8, the pneumatic conveyance 18 includes a single conveyer having a tank-outlet valve 24 in controllable fluid communication from the pneumatic pressurizer 15 to a first conveyer tube 25 in fluid communication with the bottom inside periphery of the cylinder-head portion 27 of the first pneumatic cylinder 10 and to a second conveyer tube 26 in fluid communication with the bottom inside periphery of the cylinder-head portion 27 of the second pneumatic cylinder 11. The first conveyer tube 25 and the second conveyer tube 26 are connected to the single conveyer with a two-branch connector 28. The pneumatic conveyance can include a single pressure-relief valve 29 in fluid communication from the single conveyer intermediate the two-branch connector 28 and the pneumatic pressurizer 15.

The tank-outlet valve 24 can include a valve having a tank-valve rod 30 for opening the tank-outlet valve 24 for fluid communication intermediate the pneumatic pressurizer 15 and the single conveyor of the pneumatic conveyance 18. The pressure-relief valve 29 includes a valve having a conveyer-valve rod 31 for opening the valve for fluid communication intermediate the two-branch connector 28 and the pneumatic pressurizer 15.

Referring to FIGS. 1–5, 7 and 9–10, a valve lever 32 is pivotal on a valve fulcrum 33 positioned predeterminedly intermediate the tank-valve rod 30 and the conveyer-valve rod 31 as depicted in FIG. 7. The valve lever 32 includes a first lever portion that is positioned to engage the tank-valve rod 30 for opening the tank-outlet valve 24 to allow pneumatic pressure to flow from the pneumatic pressurizer 15 into the single conveyer of the pneumatic conveyance 18. The valve lever 32 includes a second lever portion that is positioned to engage the conveyer-valve rod 31 for opening the single pressure-relief valve 29 to allow pneumatic pressure to escape from the single conveyer selectively As depicted in FIGS. 9–10, the pneumatic conveyance 18 can include a dual conveyer having a dual first tank-outlet valve 34 in controllable fluid communication from the pneumatic pressurizer 15 to a dual first conveyer tube 35 that is in fluid communication with the bottom inside periphery of the cylinder-head portion 27 of the first pneumatic cylinder 10 and having a dual second tank-outlet valve 36 in fluid communication to a dual second conveyer tube 37 that is in fluid communication with the bottom inside periphery of the cylinder-head portion 27 of the second pneumatic cylinder 11.

The pneumatic conveyance 18 can include a dual first pressure-relief valve 38 in fluid communication from the dual first conveyer tube 35 intermediate the first pneumatic cylinder 10 and the pneumatic pressurizer 15. In combination therewith, the pneumatic conveyance 18 can include a dual second pressure-relief valve 39 in fluid communication from the dual second conveyer tube 37 intermediate the second pneumatic cylinder 11 and the pneumatic pressurizer 15.

A single pneumatic cylinder 10 for lifting the front-hinged toilet seat 19 also can be operated as depicted in FIG. 11 and described in relation to FIGS. 1–5, 7 and 9–10.

Leg clamps 40 can be provided for attachment of legs of seat platforms.

A new and useful toilet-seat positioner having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A toilet-seat positioner comprising:

a base frame with a first-side rod, a second-side rod and-a frame-front rod;

the first-side rod being extended rearwardly from a first end of the frame-front rod at a first frame corner;

the second-side rod being extended rearwardly from a second end of the frame-front rod at a second frame corner;

the first-side rod being positioned a distance from the second-side rod for receiving a toilet bowl predeterminedly intermediate the first-side rod and the second-side rod;

the first-side rod having a length and the second-side rod having a length for receiving the toilet bowl predeterminedly intermediate the frame-front rod and within the length of the first-side rod and within the length of the second-side rod;

a first frame leg on which the first frame corner is positioned;

a second frame leg on which the second frame corner is positioned;

a third frame leg on which an aft end of the first-side rod is positioned;

a fourth frame leg on which an aft end of the second-side rod is positioned;

a first pneumatic cylinder having a bottom end attached predeterminedly to the base frame proximate the aft end of the first-side rod;

a second pneumatic cylinder having a bottom end attached predeterminedly to the base frame proximate the aft end of the second-side rod;

the first pneumatic cylinder having a cylinder rod attached to a pneumatic piston and extended upwardly from a top end of the first pneumatic cylinder;

the second pneumatic cylinder having a cylinder rod attached to a pneumatic piston and extended upwardly from a top end of the second pneumatic cylinder;

a seat-lift member attached predeterminedly to the cylinder rod of the first pneumatic cylinder and to the cylinder rod of the second pneumatic cylinder;

a pneumatic pressurizer on the base frame;

a pneumatic conveyance in fluid communication from the pneumatic pressurizer to a bottom inside periphery of a cylinder-head portion of the first pneumatic cylinder and to a bottom inside periphery of a cylinder-head portion of the second pneumatic cylinder selectively;

the pneumatic conveyance including fluid communication from the bottom inside periphery of the cylinder-head portion of the first pneumatic cylinder and from the bottom inside periphery of a cylinder-head portion of the second pneumatic cylinder selectively;

the cylinder rod of the first pneumatic cylinder and the cylinder rod of the second pneumatic cylinder being attached pivotally to the seat-lift member;

the seat-lift member being attachable predeterminedly to an aft portion of a front-hinged toilet seat;

the first pneumatic cylinder and the second pneumatic cylinder being attached pivotally to the base frame; and the base frame being adapted to be positioned over a portable defecation container predeterminedly.

2. The toilet-seat positioner of claim 1 wherein:

the pneumatic pressurizer includes a container of compressed air.

3. The toilet-seat positioner of claim 1 wherein:

the pneumatic pressurizer includes a pneumatic pressure container in fluid communication from an electrically motorized air compressor on the base frame.

4. The toilet-seat positioner of claim 1 wherein:

the pneumatic conveyance includes a single conveyer having a tank-outlet valve in controllable fluid communication from the pneumatic pressurizer to a first conveyer tube in fluid communication with the bottom inside periphery of the cylinder-head portion of the first pneumatic cylinder and to a second conveyer tube in fluid communication with the bottom inside periphery of the cylinder-head portion of the second pneumatic cylinder; and the first conveyer tube and the second conveyer tube are connected to the single conveyer with a two-branch connector.

5. The toilet-seat positioner of claim 4 wherein:

the pneumatic conveyance includes a single pressure-relief valve in fluid communication from the single conveyer intermediate the two-branch connector and the pneumatic pressurizer.

6. The toilet-seat positioner of claim 5 wherein:

the pressure-relief valve includes a valve having a conveyer-valve rod for opening the valve for fluid communication intermediate the two-branch connector and the pneumatic pressurizer.

7. The toilet-seat positioner of claim 6 and further comprising:

a valve lever that is pivotal on a valve fulcrum positioned predeterminedly intermediate the tank-valve rod and the conveyer-valve rod;

the valve lever includes a first lever portion that is positioned to engage the tank-valve rod for opening the tank-outlet valve to allow pneumatic pressure to flow from the pneumatic pressurizer into the single conveyer; and the valve lever includes a second lever portion that is positioned to engage the conveyer-valve rod for opening the single pressure-relief valve to allow pneumatic pressure to escape from the single conveyer.

8. The toilet-seat positioner of claim 4 wherein:

the tank-outlet valve includes a valve having a tank-valve rod for opening the valve for fluid communication intermediate the pneumatic pressurizer and the single conveyor.

9. The toilet-seat positioner of claim 1 wherein:

the pneumatic conveyance includes a dual conveyer having a dual first tank-outlet valve in controllable fluid communication from the pneumatic pressurizer to a dual first conveyer tube that is in fluid communication with the bottom inside periphery of the cylinder-head portion of the first pneumatic cylinder and having a dual second tank-outlet valve in fluid communication to a dual second conveyer tube that is in fluid communication with the bottom inside periphery of the cylinder-head portion of the second pneumatic cylinder.

10. The toilet-seat positioner of claim 9 wherein:

the pneumatic conveyance includes a dual first pressure-relief valve in fluid communication from the dual first conveyer tube intermediate the first pneumatic cylinder and the pneumatic pressurizer; and the pneumatic conveyance includes a dual second pressure-relief valve in fluid communication from the dual second conveyer tube intermediate the second pneumatic cylinder and the pneumatic pressurizer.

11. The toilet-seat positioner of claim 1 and further comprising:

a toilet-seat base on the base frame;

a toilet seat having a front portion hinged to the toilet-seat base; and an aft end of the toilet seat that is attached to the seat-lift member.

12. The toilet-seat positioner of claim 1 and further comprising:

leg clamps on the base frame for clamping onto legs of toilet-seat platforms.

* * * * *